US005611933A

United States Patent [19]

Cleveland

[11] Patent Number: 5,611,933

[45] Date of Patent: Mar. 18, 1997

[54] SLIP STREAM APPARATUS AND METHOD FOR TREATING WATER IN A CIRCULATING WATER SYSTEM

[75] Inventor: Joe R. Cleveland, West Hills, Calif.

[73] Assignee: The United States of America as represented by the Department of Energy, Washington, D.C.

[21] Appl. No.: 422,412

[22] Filed: Apr. 14, 1995

[51] Int. Cl.[6] ..... B01F 3/04

[52] U.S. Cl. ..... 210/696; 210/167; 210/188; 210/750; 261/DIG. 46

[58] Field of Search ..... 261/DIG. 46, 167, 261/188, 696, 750

[56] References Cited

U.S. PATENT DOCUMENTS

| | | | |
|---|---|---|---|
| 2,772,779 | 12/1956 | Norris | 261/DIG. 46 |
| 3,592,212 | 7/1971 | Schleimer | 261/DIG. 46 |
| 3,628,663 | 12/1971 | Derham | 261/DIG. 46 |
| 3,754,741 | 8/1973 | Whitehurst et al. | 261/DIG. 46 |
| 4,834,955 | 5/1989 | Mouche et al. | 251/DIG. 46 |
| 5,106,497 | 4/1992 | Finnegan | 210/760 |
| 5,145,585 | 9/1992 | Coke | 261/DIG. 46 |
| 5,252,300 | 10/1993 | Hinchliffe | 210/760 |
| 5,415,783 | 5/1995 | Johnson et al. | 210/764 |

*Primary Examiner*—Tim R. Miles
*Attorney, Agent, or Firm*—Robert M. Padilla; William C. Daubenspeck; William R. Moser

[57] ABSTRACT

An apparatus (10) for treating water in a circulating water system (12) that has a cooling water basin (14) includes a slip stream conduit (16) in flow communication with the circulating water system (12), a source (36) of acid solution in flow communication with the slip stream conduit (16), and a decarbonator (58) in flow communication with the slip stream conduit (16) and the cooling water basin (14). In use, a slip stream of circulating water is drawn from the circulating water system (12) into the slip stream conduit (16) of the apparatus (10). The slip stream pH is lowered by contact with an acid solution provided from the source (36) thereof. The slip stream is then passed through a decarbonator (58) to form a treated slip stream, and the treated slip stream is returned to the cooling water basin (14).

22 Claims, 4 Drawing Sheets

SLIP STREAM APPARATUS AND METHOD FOR TREATING WATER IN A CIRCULATING WATER SYSTEM

STATEMENT OF GOVERNMENT INTEREST

The Government has rights in this invention pursuant to Contract No. DE-AC03-76SF00700 awarded by the U.S. Department of Energy.

FIELD OF THE INVENTION

The present invention relates to an apparatus and method for water treatment in circulating water systems.

BACKGROUND OF THE INVENTION

Circulating water systems are commonly used to supply the cooling demands in process plants in which cooling water is an acceptable medium for heat exchange.

After passage of the circulating water through the heat exchange equipment, the water typically is cooled by passing through a cooling tower. An evaporative cooling tower commonly provides the heat removal necessary to return the circulating water to its supply temperature.

The heat transfer process in the cooling tower involves (1) latent heat transfer owing to vaporization of a small portion of the water and (2) sensible heat transfer owing to the difference in temperature of water and air. The major heat transfer is due to latent heat with a small percent due to sensible heat.

Due to the evaporation which takes place during cooling, the concentration of the dissolved solids in the circulating water increases. The water lost by evaporation must be replaced by makeup water.

The concentration of dissolved solids in the circulating water becomes greater than in the makeup water due to this evaporation loss. The term "cycles of concentration" is used to indicate the degree of concentration of the dissolved solids in the circulating water as compared with the makeup. For example, 2.0 cycles of concentration indicates that the concentration of dissolved solids in the circulating water is twice that of the makeup water.

While the evaporation loss tends to cause the dissolved solids in the water to concentrate, the windage or drift loss, which is the loss of fine droplets of water entrained by the circulating air, tends to limit the degree of concentration. This occurs because dissolved solids are present in the droplets of water and thereby leave the system with the drift loss. The drift loss, although not as large an amount as the evaporation loss, also represents a loss of water from the system and this likewise must be replaced by makeup water.

In circulating water systems, where the dissolved solids in the water are concentrated by evaporation, the problem of scale formation is increasingly troublesome. Scale is formed by solids in the water which have decreasing solubilities in water with increasing temperature. Common scale forming solids are calcium carbonate, calcium sulfate, calcium silicate and magnesium silicate. Scale formation results when the concentrations of scale forming solids exceed saturation concentrations, and the dissolved solids precipitate out of solution. Water that possesses scale forming tendencies, that is, water that has high concentrations of compounds that can form scale, becomes even more scale forming when concentrated. Even water that is not scale forming, in which, for example, the initial concentrations of these compounds is low, usually becomes scale forming when concentrated two, four or six cycles.

If solids are allowed to build up in a circulating water system, scale formation can become a serious problem. Scale can deposit and grow on the walls and surfaces of heat exchange equipment. These deposits can negatively affect heat transfer performance and restrict cooling water flow through the equipment. Eventually, it becomes necessary to shut down the process plant to clean the scale from the heat exchange equipment. The cost of cleaning and the losses associated with process plant operation down time can be extremely high.

The primary scale problem in circulating water systems is calcium carbonate scale formation, although it is also necessary to take steps to prevent the deposition of calcium and magnesium silicate and calcium sulfate scale. The low solubility of calcium carbonate, especially at higher temperatures, make it the primary target for scale reduction.

Known calcium carbonate scale treatment methods include the addition to the makeup water of anti-nucleating agents. such as polyphosphate tannin, as well as organic and inorganic surface active agents. These agents cause crystal distortion and are effective in decreasing scaling tendencies in recirculating conditions.

Relatively high concentrations of these agents are required, however, to achieve the nonscaling effect. Up to 100 ppm of these agents is required in the circulating water.

The solubility of calcium sulfate is further extended in circulating systems through the use of dispersants, sequestrants or chelants. Dispersants prevent buildup of particle size through adsorption, which involves electrostatic forces. Sequestrants and chelants function through electron transfer, forming a water soluble complex with calcium. These agents would also typically be added to the makeup water entering the circulating system and can require high treatment concentrations.

Increasing treatment concentrations cannot always control the scale problem, however. To avoid oversaturation in the circulating water with respect to calcium carbonate, as well as calcium and magnesium silicate, it is necessary to limit the cycles of concentration by means of blowdown. Blowdown consists in removing a portion of the circulating water. The concentrated water removed as blowdown is replaced with additional fresh makeup water, thus lowering the concentration in the system. Blowdown can be either intermittent or continuous. The rate of blowdown is varied to maintain the cycles of concentration within safe limits to prevent scale formation.

While blowdown is an effective method for limiting cycles of concentration and hence the scaling potential of the circulating water, it requires excessive rates of makeup water. In many locales, the supply of fresh water is either limited or costly. It would be desirable to have treatment measures that permit higher cycles of concentration in the circulating water, with corresponding lower frequencies of blowdown and required quantities of makeup water.

Known methods used to reduce blowdown while lowering scale formation include makeup stream softening and acid treatment. Softening of makeup water is most often accomplished through ion exchange.

"Hydrogen zeolite" is the name given to a group of non-siliceous organic materials, either natural or synthetic, which are capable of exchanging hydrogen ions for cations such as calcium, magnesium and sodium. See, e.g., *Betz Handbook of Industrial Water Conditioning*, Sixth Edition, 1962, Chapter 15, pp. 96–101. When the makeup water stream which contains calcium, magnesium and/or sodium ions is passed through a hydrogen zeolite these ions are exchanged for hydrogen, and bicarbonate, sulfate, nitrate and chloride radicals are converted to their respective acids: carbonic acid ($H_2CO_3$), sulfuric acid ($H_2SO_4$), nitric acid ($HNO_3$) and hydrochloric acid (HCl).

When the hydrogen zeolite bed becomes exhausted it is backwashed and regenerated with acid. It is then reused. Large investment cost is associated with such softening equipment. There is also a considerable operating cost associated with the high acid demand required to regenerate the hydrogen zeolite bed following treatment of the makeup water stream.

The carbonic acid generated in the hydrogen cation exchange decomposes to gaseous carbon dioxide and water in the treated makeup water stream. A decarbonator is commonly used to mechanically remove the carbon dioxide thus formed. The remaining acids, however, must be neutralized.

Neutralization of the acid stream is achieved by adding a suitable alkali, such as caustic soda (NaOH) or soda ash ($Na_2CO_3$) to the treated makeup water stream. This can also be a significant cost associated with present treatment methods, especially when the total volume of water is large and the total concentration of ions in the makeup water is high.

Acid treatment is another known method for reducing scale formation in a circulating water system. In conventional acid treatment, acid is added to the water in the circulating water system typically by mixing the acid with the makeup water or by adding the acid directly to the cooling water basin. Sulfuric acid is generally used because of its lower cost.

By treating the water with sulfuric acid, calcium bicarbonate in the water is converted to the more stable and more soluble calcium sulfate, as illustrated by the following reaction:

$$Ca(HCO_3)_2+H_2SO_4 \rightarrow CaSO_4+2CO_2+2H_2O$$

Thus the degree of calcium carbonate oversaturation can be lowered through sulfuric acid treatment.

There are problems associated with conventional acid treatment, however. Even the more soluble calcium sulfate is capable of forming scale in high concentrations. In addition, the extent of acid treatment is limited. An acidified condition in the circulating water must be avoided. Thus only enough acid to reduce, but not eliminate, the alkalinity of the water can be added.

A need exists for a cost effective way to reduce scale in circulating water systems that will not have the problems associated with the prior methods.

SUMMARY OF THE PREFERRED EMBODIMENTS

In accordance with one aspect of the present invention, there is provided an apparatus for treating water in a circulating water system that includes a cooling water basin. The apparatus includes a slip stream conduit in flow communication with the circulating water system. A source of acid solution is in flow communication with the slip stream conduit. A decarbonator is in flow communication with the slip stream conduit and with the cooling water basin.

According to a method aspect of the instant invention employing the inventive apparatus, a slip stream is drawn from the circulating water system into the slip stream conduit of the inventive apparatus, and the pH of the slip stream is lowered. The acidified slip stream is then supplied to the decarbonator. $CO_2$ is stripped from the acidified slip stream in the decarbonator by contact with air flowing upwardly therein to produce a treated slip stream. The treated slip stream is then returned to the cooling water basin to combine with the remaining water in the circulating water system. The return of the treated slip stream to the circulating water system enables effective control of scale formation in the circulating water system through reduction of the alkalinity of the circulating water.

Preferably, the apparatus includes an eductor in flow communication with the slip stream conduit and also with the source of acid solution. At least a portion of the slip stream is contacted with an acid solution supplied from the source thereof in the eductor and subsequently provided to the decarbonator.

According to a more specific embodiment of the inventive apparatus, the decarbonator is adapted to be in air flow communication with a water cooling tower which is included in the circulating water system. In this embodiment, the upward air flow through the decarbonator is induced by the vacuum produced in the cooling tower, According to another more specific embodiment of the inventive apparatus, a portion of the slip stream is withdrawn from the slip stream conduit and passes through a bypass in which the eductor is disposed. The withdrawn portion of the slip stream is acidified, and the acidified portion is combined with the remainder of the slip stream downstream of the eductor prior to entry into the decarbonator.

A further more specific embodiment of the inventive apparatus includes a scale monitor. The scale monitor includes a test stream conduit in connection with the slip stream conduit, and a series of heated elements in flow communication with the test stream conduit. The presence of scale in the circulating water is monitored by drawing a test stream from the slip stream, passing the test stream over the heated elements, and determining whether scale has formed on one or more of the heated elements.

Other objects, features and advantages of the present invention will become apparent to those skilled in the art from the following detailed description.

BRIEF DESCRIPTION OF THE DRAWINGS

The invention may be more readily understood by referring to the accompanying drawing in which.

In the figures, like elements are labeled alike throughout.

DETAILED DESCRIPTION OF THE PREFERRED EMBODIMENTS

Figure 1:
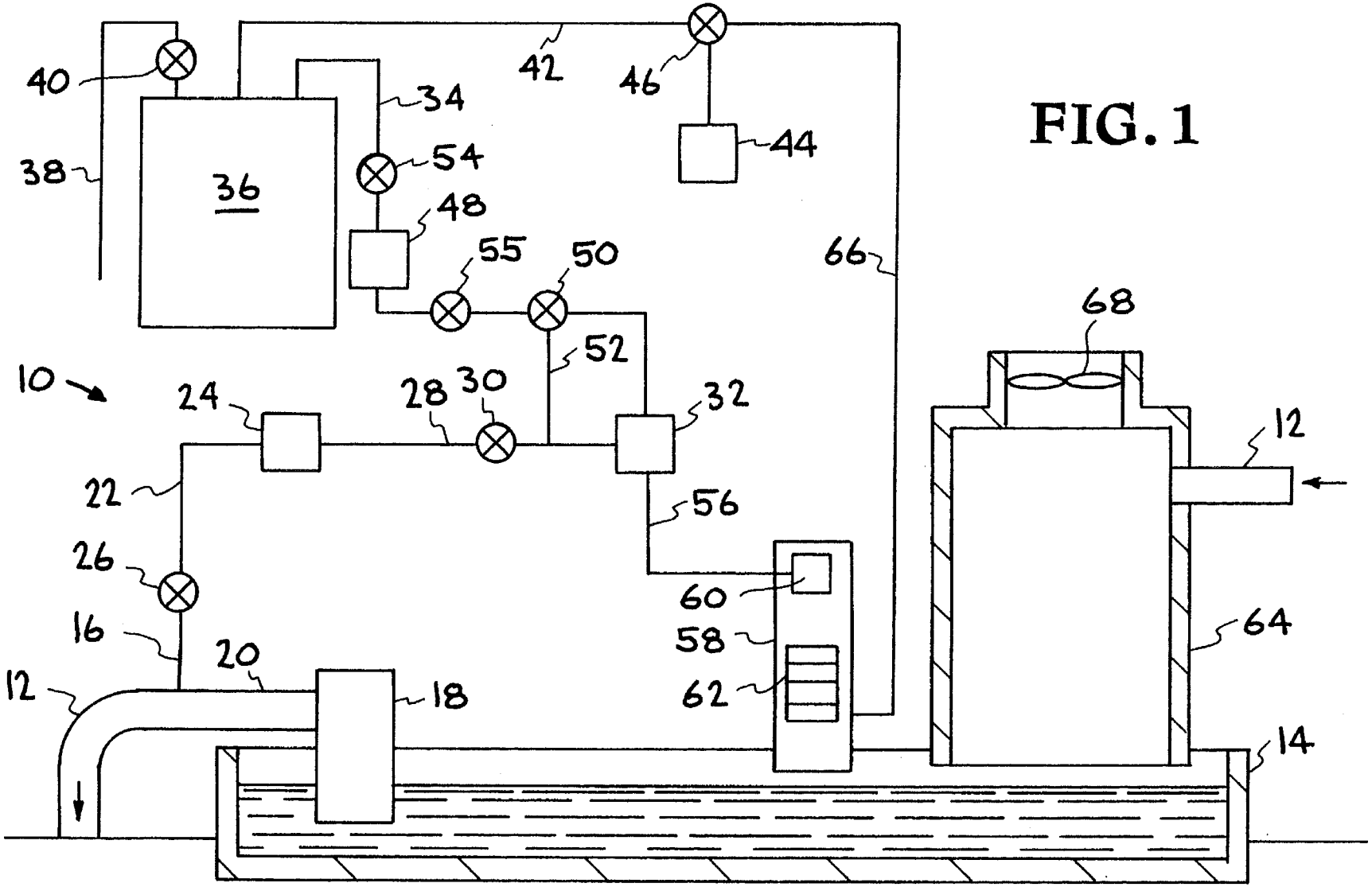
FIG. 1 is a schematic diagram of a first embodiment of a circulating water treatment apparatus in accordance with an embodiment of the present invention.

Referring now to FIG. 1, an embodiment of a water treating apparatus 10 of the invention is employed to treat water in a circulating water system 12 (partially shown) that includes cooling water basin 14. Apparatus 10 includes slip stream conduit 16 in flow communication with circulating water system 12. A slip stream of water is drawn from circulating water system 12 via slip stream conduit 16 for treatment within apparatus 10 and subsequent return to the water circulating within system 12.

Preferably, circulating water system 12 includes circulation pump 18. In this preferred embodiment, slip stream conduit 16 is connected to circulating water system 12 downstream of circulation pump 18, for example by a tee in circulation pump discharge line 20.

Slip stream conduit 16 includes inlet section 22, which optionally comprises flow metering device 24, such as a rotameter, to regulate the flow through slip stream conduit 16. Inlet section 22 also optionally includes shut-off valve 26 which can be closed to prevent flow through slip stream conduit 16 when the treatment system is not in operation.

Inlet section 22 of slip stream conduit 16 connects with mixing section 28. Mixing section 28 optionally includes shut-off valve 30, and includes eductor 32.

Acid conduit 34 is connected to eductor 32 and is in flow communication with acid solution source 36. Source 36 can be a storage tank or other vessel suited for acid solution storage. Source 36 can include fill line 38 controlled by fill valve 40, and vent line 42 connected to sump 44, or preferably to decarbonator 58 by line 66 when cooling tower 64 is in operation, via 2-way valve 46 for relief of excess pressure which may develop within source 36. Sump 44 is preferably filled with an acid absorbing material such as calcium carbonate. The vent line leading to sump 44 is used only when the cooling tower 64 is not in service.

Source 36 supplies an acid solution to eductor 32 through acid conduit 34, which optionally includes flow metering device 48, such as a rotameter, to regulate the flow of the acid solution. The acid solution preferably is a solution of hydrochloric acid or sulfuric acid. Hydrochloric acid is preferred over sulfuric acid, since use of sulfuric acid produces calcium sulfate which at high concentrations can form scale. When hydrochloric acid is employed, the strength of the hydrochloric acid solution preferably is about 30% to 35% by weight acid.

The slip stream flowing through eductor 32 via mixing section 28 of slip stream conduit 16 is brought into contact with the acid solution supplied to eductor 32 from source 36, and is thereby acidified. The pH of the acidified slip stream preferably is about 2.5 to 4.5, more preferably about 2.7 to 4.3, with about 4.3 being particularly preferred.

In a preferred embodiment, acid conduit 34 also includes sensor valve 50 immediately upstream of eductor 34. Sensor valve 50 is connected by sense line 52 to mixing conduit 28 upstream from eductor 34, and closes when it detects that flow has stopped in mixing conduit 28. Optional shut-off valve 54 and acid flow control valve 55 can also be included in acid conduit 34.

Mixing section 28 in turn is connected to outlet section 56 downstream of eductor 32. Outlet section 56 joins with decarbonator 58. Decarbonator 58 can be any standard decarbonator that is made of acid-proof material, such as wood, rubber-lined steel or plastic, with plastic being the most preferred. Decarbonator 58 preferably includes inlet distributor 60, and a plurality of contact surfaces 62 which can be trays, random packing or structured packing. Random packing is preferred and can be in the form of rings, particularly Raschig rings, saddles or other loose packing.

The acidified slip stream is supplied to inlet distributor 60 of decarbonator. 58 via outlet section 56. Within decarbonator 58; the acidified slip stream flows downward over contact surfaces 62. The downward-flowing acidified slip stream comes into contact with air flowing upward through decarbonator 58. The upward air flow conventionally is established within decarbonator 58 by means of an internal blower (not shown). Contact between the downward-flowing acidified slip stream and the upward-flowing-air strips $CO_2$ from the acidified slip stream. The stripped $CO_2$ exits decarbonator 58 With the upward-flowing air. Decarbonator vent line 66 connected to 2-way valve 46 affords beneficial usage within decarbonator 58 of any acid vapor released from acid tank 36 during normal operation of cooling tower 64. The acidified, decarbonated ("treated") slip stream exits the bottom of decarbonator 58 with a $CO_2$ concentration typically between about 5 and 10 ppm. The treated slip stream is delivered to cooling water basin 14, together with the remaining circulating water from circulating water system 12, which is cooled to its supply temperature within cooling tower 64 prior to being returned to cooling water basin 14.

By selection of the rate at which water is drawn into slip stream conduit 16 to be treated and provided to cooling water basin 14, the carbonate concentration of the water within the basin can be maintained at a desired low level, preferably about 100 to 300 ppm. Even at high cycles of concentration, the circulating water can thus be maintained in a nonscaling condition. The rate of withdrawal of water into slip stream conduit 16 should also take into account the rate at which makeup water is added to The circulating water system, the concentration of dissolved materials within the circulating water, evaporation losses and drift losses, as well the blowdown rate, if any.

Figure 2:
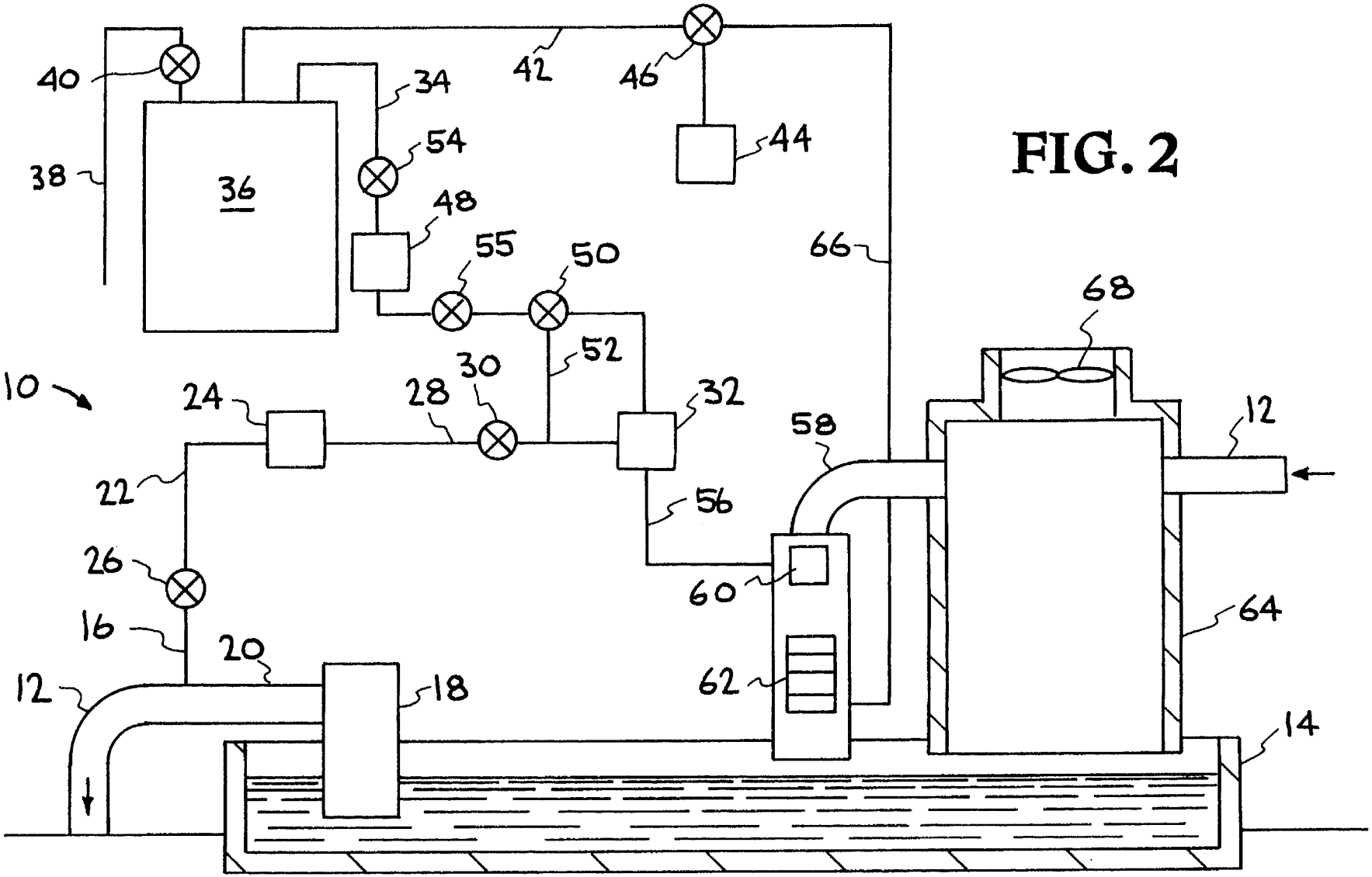
FIG. 2 is a schematic diagram of a second embodiment of the inventive apparatus in which air flow within the decarbonator is induced by connection of the decarbonator to a water cooling tower.

FIG. 2 illustrates another preferred embodiment of the inventive apparatus in which the upward air flow through decarbonator 58 is induced by cooling tower 64 rather than by an independent internal blower. In this embodiment, a conventional decarbonator 58 is modified by removing the blower and placing the top of the decarbonator in air flow communication with cooling tower 64. Operation of fan 68 on top of cooling tower 64 creates a vacuum which draws outside air through louvers (not shown) into cooling tower 64. The vacuum created in cooling tower 64 during operation provides the driving force to induce the required upward air flow through decarbonator 58. The air leaving decarbonator 58 enters the interior of cooling tower 64 and exits the top of the cooling tower along with the evaporation losses of the circulating water cooled therein. No appreciable contact is made between the air leaving decarbonator 58 and the circulating water flowing downwardly within cooling tower 64.

Cooling tower 64 can be an induced draft or forced draft, cross flow or counter flow cooling tower, but preferably is an induced draft cross flow cooling tower. An example of a cooling tower suitable for use in this embodiment of the invention is a BAC-Pritchard, Inc. Model No. 4479-4 cooling tower. Circulating water enters the top of cooling tower 64 where it is brought into contact with air flowing into cooling tower 64. Cooled water from the bottom of cooling tower 64 flows into cooling water basin 14.

Figure 3:
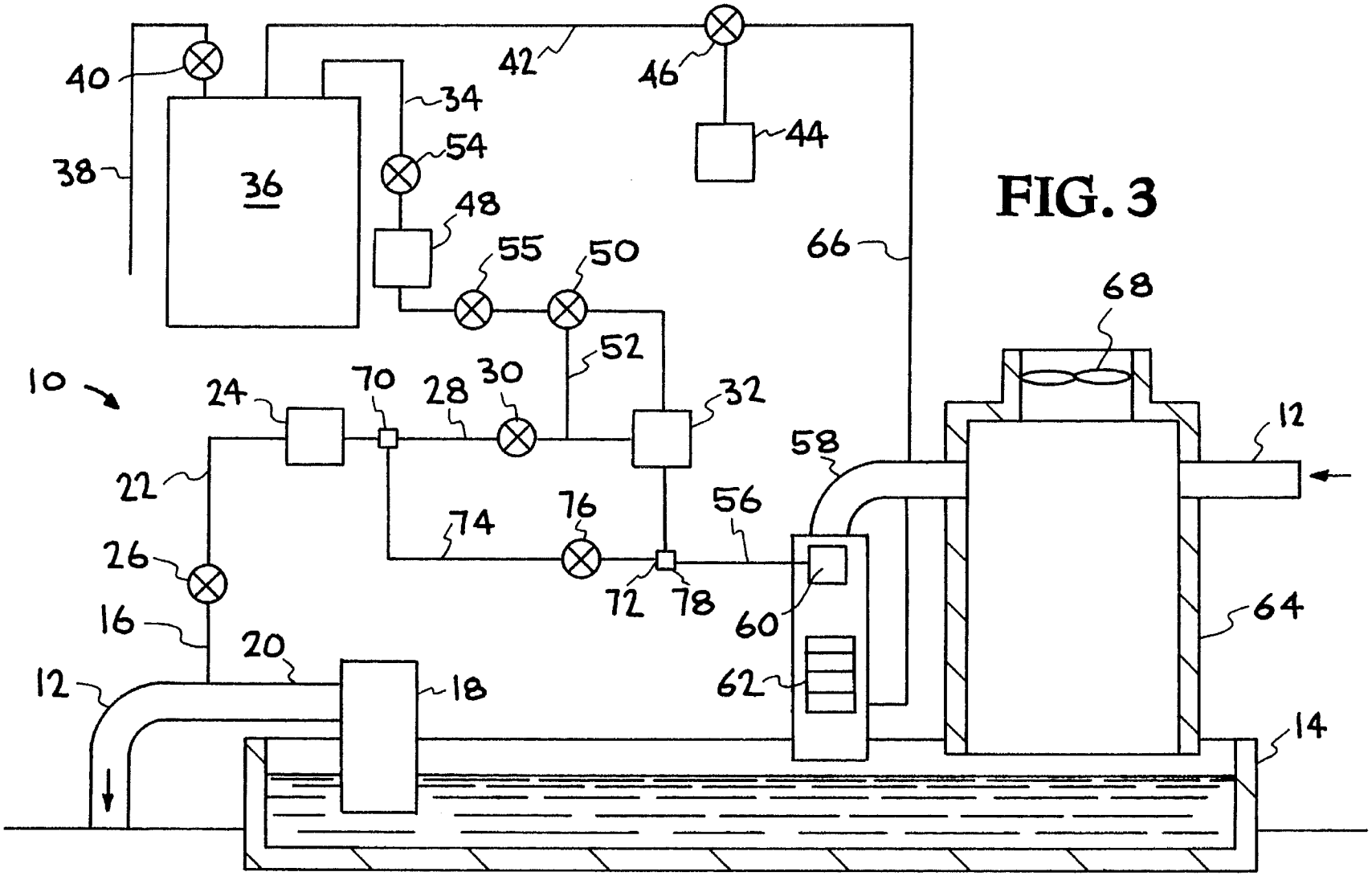
FIG. 3 is a schematic diagram of a third embodiment of the inventive apparatus illustrating the use of a bypass line for acidification of the slip stream.

FIG. 3 illustrates a particularly preferred embodiment of the inventive apparatus in which the acidification of the slip stream is carried out by adding the acid solution to a portion of the slip stream, and subsequently mixing the acidified portion with the remainder of the slip stream. In this embodiment, mixing section 28 comprises a bypass line which is connected to slip stream conduit 16 at bypass inlet 70 and bypass outlet 72. Mixing section 28 in this embodiment has a diameter which is equal to, or preferably smaller than, the diameter of slip stream conduit 16. Section 74 of slip stream conduit 16 between bypass inlet 70 and bypass outlet 72 preferably includes valve 76. Valve 76 regulates the pressure drop over section 74 of slip stream conduit 16, and hence over parallel mixing section 28. Regulation of the pressure drop along these sections regulates the operation of eductor 32. That is, the opening and closing of valve 76 adjusts the pressure drop across valve 76, and hence across eductor 32. As the pressure drop across eductor 32 increases, the driving force which draws acid solution into eductor 32 increases. In this manner, the rate of acid solution entering eductor 32 can be controlled.

Optionally, the operation of valve 76 can be controlled by a pH sensor (not shown) which detects the pH of the slip stream water downstream of eductor 32, preferably immediately upstream of decarbonator 58, and opens or closes valve 76 to increase or decrease the flow of the acidified portion of the slip stream from eductor 32.

Advantageously, the diameter of the bypass line forming mixing section 28 in this embodiment is about ½" to 1", more preferably ½", with the diameter of slip stream conduit 16 being about 2". This allows for the use of a smaller eductor, reducing the overall cost of the apparatus. Of course, the various line diameters and the sizes of the eductor and other components of the apparatus can be selected as desired, and such selection represents the exercise of ordinary design choice.

Mixing section 28 can be connected to slip stream conduit 16 at bypass outlet 72 by any desired means, such as a tee. In a preferred embodiment, mixing section 28 and slip stream conduit 16 rejoin by means of a modified venturi 78. Venturi 78 is modified such that an opening is formed in the wall of the narrowest portion thereof, preferably the middle region of the venturi. Mixing section 28, supplying the acidified portion of the slip stream, is connected to venturi 78 such that the acidified portion passes through the opening in venturi 78 and into contact with the remaining portion of the slip stream flowing in slip stream conduit 16. The combined, acidified slip stream leaving venturi 78 experiences an increase in velocity due to the increased flow area, thereby creating turbulent mixing. The acidified slip stream is then provided to decarbonator 58 in the manner previously described.

Figure 4:
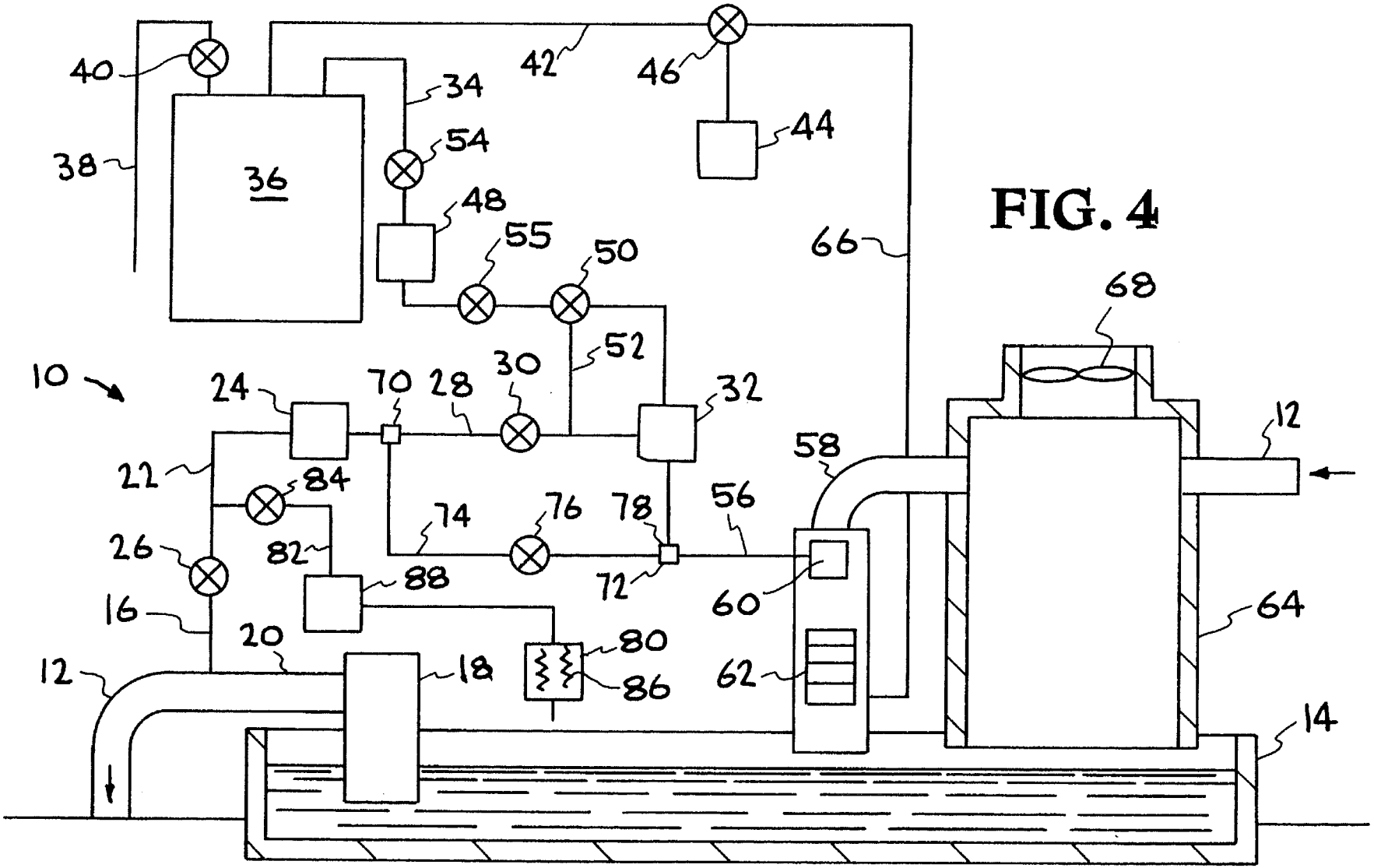
FIG. 4 is a schematic diagram of a fourth embodiment of the inventive apparatus including a test conduit for monitoring the level of scale in the circulating water.

A fourth embodiment of the inventive apparatus as shown in FIG. 4 provides the capability of monitoring the presence of scale in the circulating water. Scale monitor 80 includes test stream conduit 82 connected to slip stream conduit 16, preferably at a point within inlet section 22. Monitor valve 84 controls the flow of the test stream from slip stream conduit 16 into scale monitor 80. Test stream conduit 82 is in flow communication with a series of heated elements 86, and optionally with flow metering device 88. In a preferred embodiment, the elements 86 are removable. The elements 86 are heated to temperatures corresponding to the temperatures experienced by the cooling water in the process heat exchange equipment.

In operation, the test stream flows in contact with the heated elements 86 before exiting test stream conduit 82 to be discarded, or optionally to be returned to cooling water basin 14. Each heating element 86 is periodically inspected, preferably after removal from the scale monitor, to determine if scale has formed. Scale formation results if the concentration of scale forming materials exceeds the saturation concentration at the elevated temperatures produced by the heated elements. Use of a series of heated elements 86 at sequentially increasing temperature allows more precise determination of the concentration of scale forming materials in the test stream.

Use of the apparatus and methods of the instant invention obviates the need for fully treating the makeup water, if any, which may be fed to cooling water basin 14. A sodium based zeolite can be used instead of the more expensive hydrogen based zeolite. Calcium and magnesium ions are removed, but sodium ions can be left in the makeup water stream. This is less costly than the hydrogen based zeolite presently used which removes all these ions. In addition, the high acid demand of the hydrogen based zeolite is avoided. Nor is the addition of caustic required to neutralize the effluent.

Likewise, advantages over conventional acid treatment are present. The pH of the circulating water in cooling water basin 14 is preferably maintained at around 8.5 to 9, preferably about 8.5. Thus, an acid condition is avoided. Also, overall acid rates are relatively low since in the present invention only a slip stream is treated, instead of the entire circulating water stream as in prior methods.

Blowdown is also minimized. Due to the effectiveness of the inventive treatment, continuous blowdown is not required. Periodic removal of a portion of water from cooling water basin 14 is usually sufficient to prevent the build up of solids in the circulating water system. This can be accommodated by periodic hauling away of water in trucks at considerably less cost than a continuous blowdown, and its accompanying makeup water requirement.

The detailed description and specific examples set forth above, while indicating preferred embodiments of the present invention, are given by way of illustration and not limitation. Many changes and modifications within the scope of the present invention may be made without departing from the spirit thereof, and the invention includes all such modifications.

What is claimed is:

1. An apparatus for treating water in a circulating water system that includes a cooling water basin, said apparatus comprising:

a slip stream conduit in flow communication with said circulating water system;

a source of acid solution in flow communication with said slip stream conduit; and a decarbonator in flow communication with said slip stream conduit and said cooling water basin.

2. The apparatus of claim 1 further comprising an eductor in flow communication with said slip stream conduit, said source of acid solution being in flow communication with said eductor.

3. The apparatus of claim 2 further comprising a conduit in parallel flow communication with said eductor, and a valve on said conduit in parallel flow communication with said eductor.

4. The apparatus of claim 1 further comprising a venturi in flow communication with said slip stream conduit, said venturi having an opening formed therein, said source of acid solution being in flow communication with said venturi via said opening.

5. The apparatus of claim 1 wherein said circulating water system includes a circulation pump and said slip stream conduit is connected to said circulating water system downstream of said circulation pump.

6. The apparatus of claim 1 wherein said source of acid solution is a source of a solution of an acid selected from the group consisting of hydrochloric acid and sulfuric acid.

7. The apparatus of claim 1 wherein said circulating water system includes a cooling tower, and said decarbonator is in air flow communication with said cooling tower.

8. The apparatus of claim 1 further comprising a scale monitor, said scale monitor being in flow communication with said slip stream conduit, said scale monitor comprising a test stream conduit and a series of heated elements in flow communication with said test stream conduit.

9. A method for treating water in a circulating water system that includes a cooling water basin, said method comprising the steps of:

(a) drawing a slip stream of circulating water from said circulating water system;

(b) lowering the pH of said slip stream;

(c) passing said slip stream through a decarbonator thereby forming a treated slip stream; and (d) returning said treated slip stream from said decarbonator to said cooling water basin.

10. The method of claim 9 wherein in step (b) the pH of said slip stream is lowered to a pH from about 2.7 to 4.3.

11. The method of claim 9 wherein step (b) comprises supplying an acid solution and contacting said acid solution with said slip stream.

12. The method of claim 9 wherein in step (b) said acid solution comprises an acid selected from the group consisting of hydrochloric acid, sulfuric acid and mixtures thereof.

13. The method of claim 12 wherein said acid solution is a hydrochloric acid solution having a concentration from about 30% to 35% by weight.

14. The method of claim 12 wherein in step (b) at least a portion of said slip stream is passed through an eductor, and said acid solution is drawn into said eductor and into contact with said circulating water.

15. The method of claim 14 wherein in step (b) a portion of said slip stream is passed through said eductor and contacted with said acid solution to form an acidified portion, and said acidified portion is subsequently combined with the remainder of said slip stream.

16. The method of claim 15 wherein said remainder of said slip stream is passed through a valve prior to combination with said acidified portion, whereby the pressure of said remainder of said slip stream is reduced, and wherein the pressure reduction across said valve regulates the flow of said acid solution drawn into said eductor and brought into contact with said portion of said slip stream.

17. The method of claim 9 wherein the pH of the circulating water in said cooling water basin is maintained from about 8.5 to 9.

18. The method of claim 9 wherein the carbonate concentration of said circulating water in said cooling water basin is maintained at a concentration of about 100 to 300 ppm by weight.

19. The method of claim 9 wherein in step (c) said treated slip stream has a $CO_2$ concentration from about 5 to 10 ppm by weight.

20. The method of claim 9 further comprising the step of monitoring the scale in said circulating water.

21. The method of claim 20 wherein said monitoring step comprises drawing a test stream from said slip stream, passing said test stream over a series of heated elements, and determining whether scale has formed in any of said elements.

22. A method for treating water in a circulating water system that includes a cooling water basin, said method comprising the steps of:

(a) drawing a slip stream of circulating water from said circulating water system;

(b) lowering the pH of said slip stream;

(c) decarbonating said slip stream thereby forming a treated slip stream; and (d) returning said treated slip stream to said cooling water basin.

* * * * *